US009976415B2

(12) United States Patent
Logan et al.

(10) Patent No.: US 9,976,415 B2
(45) Date of Patent: May 22, 2018

(54) ELECTROMAGNETIC TELEMETRY SYSTEM WITH COMPENSATION FOR DRILLING FLUID CHARACTERISTICS

(71) Applicant: Evolution Engineering Inc., Calgary (CA)

(72) Inventors: Justin C. Logan, Calgary (CA); Aaron W. Logan, Calgary (CA); Patrick R. Derkacz, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days. days.

(21) Appl. No.: 15/167,814

(22) Filed: May 27, 2016

(65) Prior Publication Data

US 2016/0348499 A1 Dec. 1, 2016

Related U.S. Application Data

(60) Provisional application No. 62/166,790, filed on May 27, 2015.

(51) Int. Cl.
*G01V 3/00* (2006.01)
*E21B 47/12* (2012.01)

(52) U.S. Cl.
CPC ..... *E21B 47/123* (2013.01); *E21B 47/121* (2013.01)

(58) Field of Classification Search
CPC ..... E21B 47/18
USPC ..... 340/854.7
See application file for complete search history.

(56) References Cited

U.S. PATENT DOCUMENTS

| | | | | |
|---|---|---|---|---|
| 4,578,675 | A | 3/1986 | MacLeod | |
| 5,160,925 | A | 11/1992 | Dailey et al. | |
| 5,467,083 | A | 11/1995 | McDonald et al. | |
| 5,883,516 | A | 3/1999 | Van Steenwyk et al. | |
| 7,080,699 | B2 | 7/2006 | Lovell et al. | |
| 7,436,184 | B2 | 10/2008 | Moore | |
| 7,782,060 | B2 | 8/2010 | Clark et al. | |
| 8,416,098 | B2 * | 4/2013 | Garcia-Osuna | G01V 11/002 340/854.3 |

(Continued)

FOREIGN PATENT DOCUMENTS

| | | | |
|---|---|---|---|
| CA | 2593943 | A1 | 6/2008 |
| CN | 203321511 | U | 12/2013 |

(Continued)

*Primary Examiner* — Santiago Garcia
(74) *Attorney, Agent, or Firm* — Oyen Wiggs Green & Mutala LLP

(57) ABSTRACT

A downhole apparatus for measuring drilling fluid characteristics. The downhole apparatus may comprise one or more sensors located within a housing. The sensors may include one or more of an imaging device, a resistivity/conductivity sensor, a temperature sensor, a pressure sensor, a flowmeter and a fluid density sensor. The downhole apparatus may also include a controller for receiving measurements and/or determining optimal electromagnetic telemetry transmission settings. The downhole apparatus may also comprise a transmitter for transmitting the measurements and/or the optimal electromagnetic transmission settings. The downhole apparatus may be operated to determine optimal transmission settings for an electromagnetic telemetry system. Optimal transmission settings may include settings relating to one or more of frequency, amplitude, voltage, current, and power.

26 Claims, 6 Drawing Sheets

(56) References Cited

U.S. PATENT DOCUMENTS

| | | | | |
|---|---|---|---|---|
| 2003/0090390 | A1* | 5/2003 | Snider | E21B 17/006 340/853.3 |
| 2006/0139646 | A1* | 6/2006 | DiFoggio | E21B 49/10 356/436 |
| 2007/0052551 | A1 | 3/2007 | Lovell et al. | |
| 2009/0066334 | A1 | 3/2009 | Peter | |
| 2012/0076364 | A1 | 3/2012 | Tjhang et al. | |
| 2013/0021874 | A1* | 1/2013 | Hartog | E21B 47/101 367/31 |
| 2013/0043874 | A1 | 2/2013 | Clark et al. | |
| 2013/0093597 | A1* | 4/2013 | Stolpman | G01V 3/38 340/854.3 |
| 2013/0257436 | A1 | 10/2013 | Bittar et al. | |
| 2013/0328692 | A1 | 12/2013 | Johannessen | |
| 2014/0132271 | A1* | 5/2014 | Liu | G01V 3/20 324/338 |
| 2014/0218037 | A1* | 8/2014 | Slater | G01V 3/28 324/339 |
| 2015/0145687 | A1* | 5/2015 | Roberts | E21B 47/122 340/853.2 |
| 2015/0176368 | A1* | 6/2015 | Martin | E21B 34/045 137/71 |
| 2016/0024906 | A1* | 1/2016 | Jamison | E21B 47/10 175/25 |
| 2016/0047189 | A1* | 2/2016 | MacLeod | E21B 23/06 166/377 |
| 2016/0130937 | A1* | 5/2016 | Logan | E21B 47/18 367/83 |
| 2016/0178793 | A1* | 6/2016 | Vijayakumar | G01N 33/2841 356/409 |
| 2016/0201455 | A1* | 7/2016 | Liu | H04W 52/0245 340/854.6 |
| 2016/0356692 | A1* | 12/2016 | Ye | G01N 21/49 |

FOREIGN PATENT DOCUMENTS

| | | | |
|---|---|---|---|
| EP | 1035299 | A2 | 9/2000 |
| EP | 0916101 | B1 | 4/2008 |
| GB | 2419419 | B | 3/2007 |
| WO | 2010065205 | A1 | 6/2010 |
| WO | 2014071520 | A1 | 5/2014 |
| WO | 2014134727 | A1 | 9/2014 |

* cited by examiner

ELECTROMAGNETIC TELEMETRY SYSTEM WITH COMPENSATION FOR DRILLING FLUID CHARACTERISTICS

TECHNICAL FIELD

This application relates to subsurface drilling, specifically to an electromagnetic telemetry system with compensation for drilling fluid characteristics. Embodiments are applicable to drilling wells for recovering hydrocarbons.

BACKGROUND

Recovering hydrocarbons from subterranean zones typically involves drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid, usually in the form of a drilling "mud", is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit, a BHA may comprise elements such as: apparatus for steering the direction of the drilling (e.g. a steerable downhole mud motor or rotary steerable system); sensors for measuring properties of the surrounding geological formations (e.g. sensors for use in well logging); sensors for measuring downhole conditions as drilling progresses; one or more systems for telemetry of data to the surface; stabilizers; heavy weight drill collars; pulsers; and the like. The BHA is typically advanced into the wellbore by a string of metallic tubulars (drill pipe).

Modern drilling systems may include any of a wide range of mechanical/electronic systems in the BHA or at other downhole locations. Such electronics systems may be packaged as part of a downhole probe. A downhole probe may comprise any active mechanical, electronic, and/or electromechanical system that operates downhole. A probe may provide any of a wide range of functions including, without limitation: data acquisition; measuring properties of the surrounding geological formations (e.g. well logging); measuring downhole conditions as drilling progresses; controlling downhole equipment; monitoring status of downhole equipment; directional drilling applications; measuring while drilling (MWD) applications; logging while drilling (LWD) applications; measuring properties of downhole fluids; and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. A downhole probe is typically suspended in a bore of a drill string near the drill bit. Some downhole probes are highly specialized and expensive.

A downhole probe may communicate a wide range of information to the surface by telemetry. Telemetry information can be invaluable for efficient drilling operations. For example, telemetry information may be used by a drill rig crew to make decisions about controlling and steering the drill bit to optimize the drilling speed and trajectory based on numerous factors, including legal boundaries, locations of existing wells, formation properties, hydrocarbon size and location, etc. A crew may make intentional deviations from the planned path as necessary based on information gathered from downhole sensors and transmitted to the surface by telemetry during the drilling process. The ability to obtain and transmit reliable data from downhole locations allows for relatively more economical and more efficient drilling operations.

There are several known telemetry techniques. These include transmitting information by generating vibrations in fluid in the bore hole (e.g. acoustic telemetry or mud pulse (MP) telemetry) and transmitting information by way of electromagnetic signals that propagate at least in part through the earth (EM telemetry). Other telemetry techniques use hardwired drill pipe, fibre optic cable, or drill collar acoustic telemetry to carry data to the surface.

Advantages of EM telemetry, relative to MP telemetry, include generally faster baud rates, increased reliability due to no moving downhole parts, high resistance to lost circulating material (LCM) use, and suitability for air/underbalanced drilling. An EM system can transmit data without a continuous fluid column; hence it is useful when there is no drilling fluid flowing. This is advantageous when a drill crew is adding a new section of drill pipe as the EM signal can transmit information (e.g. directional information) while the drill crew is adding the new pipe. Disadvantages of EM telemetry include lower depth capability, incompatibility with some formations (for example, high salt formations and formations of high resistivity contrast), and some market resistance due to acceptance of older established methods. Also, as the EM transmission is strongly attenuated over long distances through the earth formations, it requires a relatively large amount of power so that the signals are detected at surface. The electrical power available to generate EM signals may be provided by batteries or another power source that has limited capacity.

A typical arrangement for electromagnetic telemetry uses parts of the drill string as an antenna. The drill string may be divided into two conductive sections by including an insulating joint or connector (a "gap sub") in the drill string. The gap sub is typically placed at the top of a bottom hole assembly such that metallic drill pipe in the drill string above the BHA serves as one antenna element and metallic sections in the BHA serve as another antenna element. Electromagnetic telemetry signals can then be transmitted by applying electrical signals between the two antenna elements. The signals typically comprise very low frequency AC signals applied in a manner that codes information for transmission to the surface. (Higher frequency signals attenuate faster than low frequency signals.) The electromagnetic signals may be detected at the surface, for example by measuring electrical potential differences between the drill string or a metal casing that extends into the ground and one or more ground rods.

There remains a need for reliable and effective telemetry. There is a particular need for high performance telemetry that can monitor, adapt to and/or be adapted to varying downhole conditions.

SUMMARY

The invention has a number of different aspects. These include, without limitation:

electromagnetic telemetry systems comprising one or more downhole apparatuses for measuring fluid characteristics and a control system which determines optimal electromagnetic telemetry transmission settings based at least in part on fluid properties sensed by the one or more downhole apparatus;

electromagnetic telemetry systems with compensation for drilling fluid characteristics; and methods for adjusting electromagnetic telemetry systems based on drilling fluid characteristics.

One example aspect provides a downhole apparatus for measuring fluid characteristics. The downhole apparatus may comprise one or more sensors located within a housing. In some embodiments, the sensors include one or more of an imaging device, a temperature sensor, a pressure sensor, a flowmeter and a fluid density sensor. The downhole apparatus may also include a controller for receiving measurements and/or determining optimal electromagnetic telemetry transmission settings. The downhole apparatus may also comprise a transmitter for transmitting the measurements and/or the optimal electromagnetic transmission settings.

Another example aspect of the invention provides a method for optimizing electromagnetic telemetry. The method may comprise measuring one or more drilling fluid characteristics, determining optimal transmission settings for an electromagnetic telemetry system based on at least one of the one or more drilling fluid characteristics, transmitting the optimal transmission settings to one or more electromagnetic transmitters and operating the electromagnetic telemetry system according to the optimal transmission settings.

In some embodiments, the method may allow for user input to accept, reject or alter the optimal transmission settings. The optimal transmission settings may be determined downhole or at the surface of the drilling rig. One or more of the one or more drilling fluid characteristics may be measured by an imaging device, such as a spectrometer. The drilling fluid characteristics may comprise one or more of fluid composition, fluid temperature, fluid pressure, fluid volume, fluid density, conductivity, resistance, etc. The optimal transmission settings may comprise one or more of EM telemetry signal frequency, EM telemetry signal amplitude, EM telemetry signal encoding scheme, voltage, current, power, etc.

Another example aspect of the invention provides an electromagnetic telemetry system having a plurality of downhole apparatuses for measuring fluid characteristics. Each downhole apparatus is spaced apart along the drill string. Each apparatus along the drill sting may measure fluid characteristics at its spaced apart location along the drill sting. Transmission settings for electromagnetic transmitters may be adjusted according to the fluid characteristics as measured by the nearest downhole apparatus. Accordingly, electromagnetic transmitters along the drill string may operate using different transmission settings in order to minimize attenuation and noise.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Figure 1:
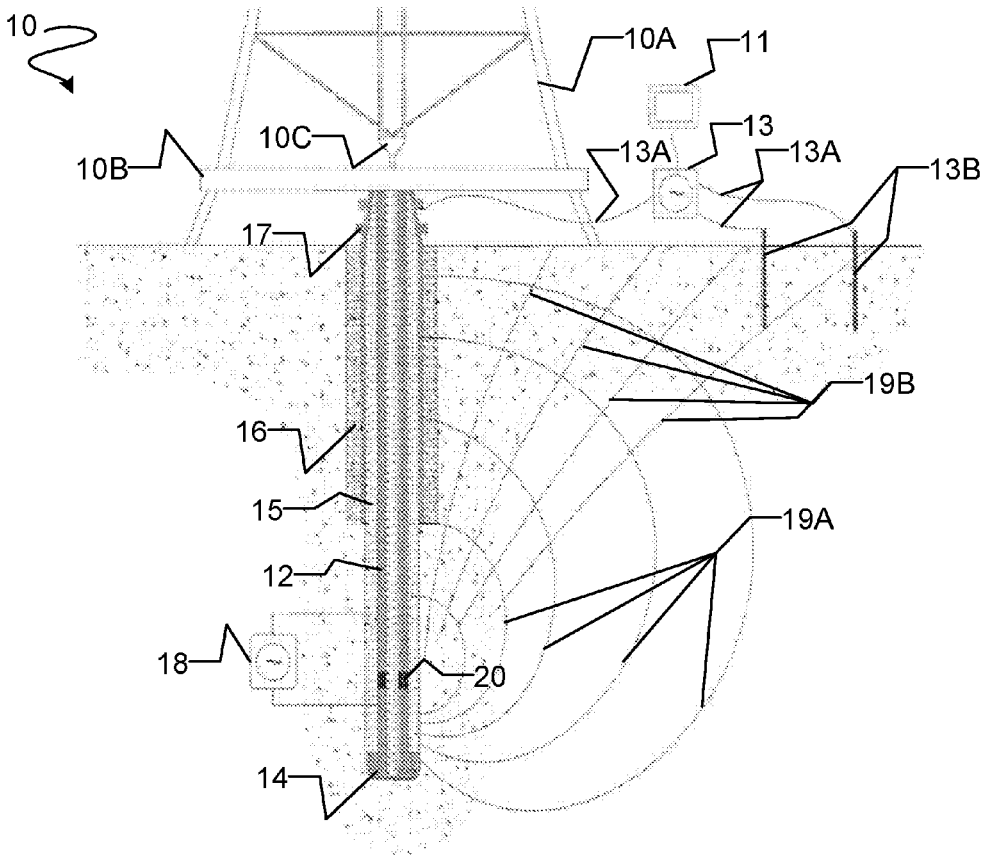
FIG. 1 is a schematic view of a drilling operation.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 10C for supporting the drill string. Drill bit 14 is larger in diameter than the drill string above the drill bit. An annular region 15 surrounding the drill string is typically filled with drilling fluid. The drilling fluid is pumped through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

A gap sub 20 may be positioned, for example, at the top of the BHA. Gap sub 20 divides the drill string into two electrically-conductive parts that are electrically insulated from one another. The two parts form a dipole antenna structure. For example, one part of the dipole may be made of the BHA up to the electrically insulating gap and the other part of the dipole may be made up of the part of the drill string extending from the gap to the surface.

A very low frequency alternating current (AC) electrical signal 19A is generated by an EM telemetry signal generator 18 and applied across gap sub 20. The low frequency AC signal energizes the earth and creates an electrical field 19A which results in a measurable voltage differential between the top of drill string 12 and one or more grounded electrodes (such as ground rods or ground plates). Electrical signal 19A is varied in a way which encodes information for transmission by telemetry.

At the surface the EM telemetry signal is detected. Communication cables 13A transmit the measurable voltage differential between the top of the drill string and one or more grounded electrodes 13B located about the drill site to a signal receiver 13. The grounded electrodes 13B may be at any suitable locations. Signal receiver 13 decodes the transmitted information. A display 11 displays some or all of the received information. For example, display 11 may display received measurement while drilling information to the rig operator.

Whether or not EM telemetry transmissions from a downhole source can be reliably detected at the surface can depend on many factors. Some of these factors have to do with the characteristics of the underground formations through which the well bore from which the electromagnetic telemetry is being performed passes. The electrical conductivity of the underground environment can play a major role in the effectiveness of electromagnetic telemetry (higher electrical conductivity, especially in the vicinity of gap sub 20 tends to attenuate EM telemetry signals). Both the average electrical conductivity of the underground environment as well as the way in which the electrical conductivity may vary from place to place can play significant roles in whether particular EM telemetry signals can be received reliably at the surface.

Another factor that can affect electromagnetic telemetry is the depth from which electromagnetic telemetry is being performed. In general, electromagnetic telemetry signals become more highly attenuated as the depth from which the electromagnetic telemetry signals are being transmitted increases.

Another factor that may affect the success in receiving EM telemetry transmissions at the surface is the particular arrangement of signal detectors provided at the surface (e.g. the particular arrangement of grounding rods and other apparatus used at the surface as well as the sensitivity of the circuitry used to detect EM telemetry signals).

Other factors include: whether or not the wellbore is cased and, if so, how deep the casing extends; and the inclination of the portion of the drill bore in which the EM telemetry signal generator is located. It tends to be much more challenging to achieve effective EM telemetry transmission from a cased horizontal well bore than from an uncased vertical well bore.

Another factor that can affect the success of EM telemetry signal transmissions is the drilling activity that is occurring at the time of the transmissions. For example, drilling often has a number of phases. In one phase (which typically includes the time at which a new section of drill string is being added or taken off of the drill string) the bore hole is quiet. Drilling fluid is not being pumped through the drill string (i.e. "pumps off"). At other phases of the drilling operation drilling fluid is being pumped through the drill string. Active drilling may include different modes of operation. In some modes of operation the entire drill string is rotating as drilling progresses. In another "sliding" mode of operation the drill bit is rotated by a downhole mud motor and the drill string is not rotated except as is necessary or desirable to steer the direction in which the drill bit is progressing. Which of these modes is occurring can affect EM telemetry by creating electrical noise and the like.

Another factor that can affect the effectiveness of EM telemetry transmissions is whether and how much drilling fluid is used (e.g. underbalanced drilling may use less and/or less dense drilling fluids; in air-based underbalanced drilling the wellbore may be air-filled), the nature of drilling fluid being used (whether the drilling fluid is oil-based or water-based), and the specific characteristics of any drilling fluid being used such as, for example, the pressure, temperature, phase behaviour, electrical conductivity/resistivity and other fluid properties.

The combination of all the above factors creates a challenging environment for electromagnetic telemetry, especially where it is desired to optimize the electromagnetic telemetry to conserve electrical power and to maximize data throughput, where desired.

In situations where EM telemetry is more difficult, for example because of factors such as one or more of the above (and most typically a combination of several of the above), one can adjust the nature of the EM telemetry signals to improve the reliability of the EM telemetry channel. The characteristics of EM telemetry signals themselves can affect their successful transmission to the surface. One characteristic that has particular significance is the frequency at which the EM telemetry signals alternate in polarity and/or magnitude.

In general, lower-frequency EM telemetry signals can be successfully transmitted from deeper locations than higher frequency EM telemetry signals. For this reason, EM telemetry signals typically have very low frequencies. For example, EM telemetry signals generally have frequencies in the band below 24 Hertz. For example, EM telemetry signals according to some embodiments of the invention have frequencies in the range of about 1/10 Hertz to about 20 Hertz. The exact endpoints of these ranges are not critically important.

One advantage of the use of higher frequencies for EM telemetry is that the rate at which data can be encoded in higher-frequency EM telemetry signals is greater than the rate at which the data can be encoded in lower-frequency EM telemetry signals. Consequently, there is a trade-off between increasing the likelihood that EM signals can be successfully transmitted from a given depth by using very low frequencies and maintaining an increased data rate by using higher frequencies. Furthermore, if the frequency is too high then the EM signals will be so strongly attenuated that no practical detector could pick them up at the surface.

Selection of carrier frequency for EM telemetry signals can have consequences beyond the amount of time required to transmit a certain amount of data to the surface. For example, transmitting at higher frequencies may significantly affect the amount of electrical power required to transmit a certain amount of data. One reason for this is that if data can be transmitted quickly then, after the data has been transmitted (or in other periods during which it is not necessary to be transmitting data), certain circuits may be shut down to conserve electrical power. In addition, since the electrical impedance seen by an EM telemetry transmitter is somewhat frequency dependent, the amount of electrical power required to sustain an EM telemetry signal is also frequency dependent to some degree. On the other hand, higher frequencies are attenuated more strongly than lower frequencies and so higher frequency signals may need to be transmitted at higher amplitudes (thereby requiring more electrical power).

Another factor that influences the success of EM telemetry transmissions is the amplitude of the EM telemetry signals. Increased amplitude signals are easier to detect at the surface. However, the amplitude of EM telemetry signals may be limited by the capabilities of the downhole EM telemetry transmitter. For example, if the EM telemetry transmitting circuits can deliver only up to a maximum electrical current then the amplitude of the EM telemetry signal will also be limited.

Other limits are imposed by the maximum voltage that can be imposed by the EM telemetry transmitter on the downhole antenna elements. The voltage of an EM telemetry signal may be limited by the nature of the EM telemetry signal generator as well as its power source. In some cases the voltage may be limited by design to being below a threshold voltage for safety reasons. For example, in some embodiments, the voltage may be limited to a voltage of 50 volts or less in order to reduce the likelihood that personnel who are handling the EM telemetry signal generator at the surface could be exposed to electrical shocks and/or to reduce the likelihood that the EM signal generator could serve as an ignition source.

The voltage that may be applied across the EM telemetry antenna elements may also depend on the characteristics of the gap. Typically, for a longer gap, a larger voltage may be applied without exceeding the electrical current capabilities of the EM telemetry signal generator. In addition to the above, increasing the amplitude of EM telemetry signals generally results in increased electrical power consumption. It is therefore desirable not to transmit EM telemetry signals that have amplitudes much greater than necessary.

The encoding scheme used to transmit EM telemetry signals can also play a role in the success with which the EM telemetry signals can be received. For example, if the encoding scheme is such that it encodes information by, at least in part, transmitting EM telemetry signals of different amplitudes then it may be necessary for all of the different amplitudes which are part of the encoding scheme to be detectable at the surface for the EM telemetry transmission to be successfully received. If only some of the amplitudes are received at the surface it may not be possible to recover the transmitted information at the surface.

As another example, different encoding schemes may use different numbers of cycles to encode symbols for transmission. For example, in low-noise environments one may be able to successfully transmit EM telemetry symbols using an encoding scheme which transmits one symbol in two cycles of the EM telemetry signal. In higher noise environments it may be desirable or necessary to use an encoding scheme which transmits one symbol in three or more cycles of the EM telemetry signal.

One aspect of the present invention provides a system for optimizing EM telemetry by automatically selecting or assisting a user in the selection of appropriate EM telemetry parameters which may include one or more of: voltage, current, power, EM telemetry signal carrier frequency, EM telemetry signal amplitude, and EM telemetry signal data encoding scheme. In particular, appropriate EM telemetry parameters are set based at least in part on fluid analysis.

Various types of downhole drilling fluids may be employed in drilling rig 10. Each type of drilling fluid may have different characteristics. Possible types of drilling fluid employed in drilling rig 10 include, but are not limited to: water-based fluids such as non-dispersed systems, dispersed systems, saltwater drilling fluids, polymer drilling fluids; drill in fluids; oil-based fluids; synthetic-based drilling fluids; all-oil fluids; and pneumatic-drilling fluids such as air, mist, foam or gas. Drilling fluid may be changed during drilling. Drilling fluid may also contain additives such as lost-circulation materials, spotting fluids, lubricants and protective chemicals such as scale and corrosion inhibitors, biocides, and hydrogen sulfide scavengers.

Fluid analysis may involve evaluating one or more of: the composition (or the change in composition), phase behaviour, pressure, temperature, density, volume, electrical resistivity/conductivity, solids content (percentage by volume and/or type of solids) and/or other properties that determine a behaviour of the various components of drilling fluid.

In some embodiments, drilling rig 10 includes an apparatus 50 for analyzing fluid. Apparatus 50 may be located anywhere on drill string 12, where space permits. For example, apparatus 50 for analyzing fluid may be located in a downhole probe, in a sub such as a gap sub, near the drill bit, on the surface in a mud tank, pump shack, draw works or top drive or elsewhere. Apparatus 50 may be integrated into a pre-existing downhole element such as a downhole probe containing other sensors or may be a standalone unit. Apparatus 50 may comprise threaded couplings for attaching apparatus 50 inline in drill string 12. The threaded couplings may form part of the housing of apparatus 50.

Figure 1A:
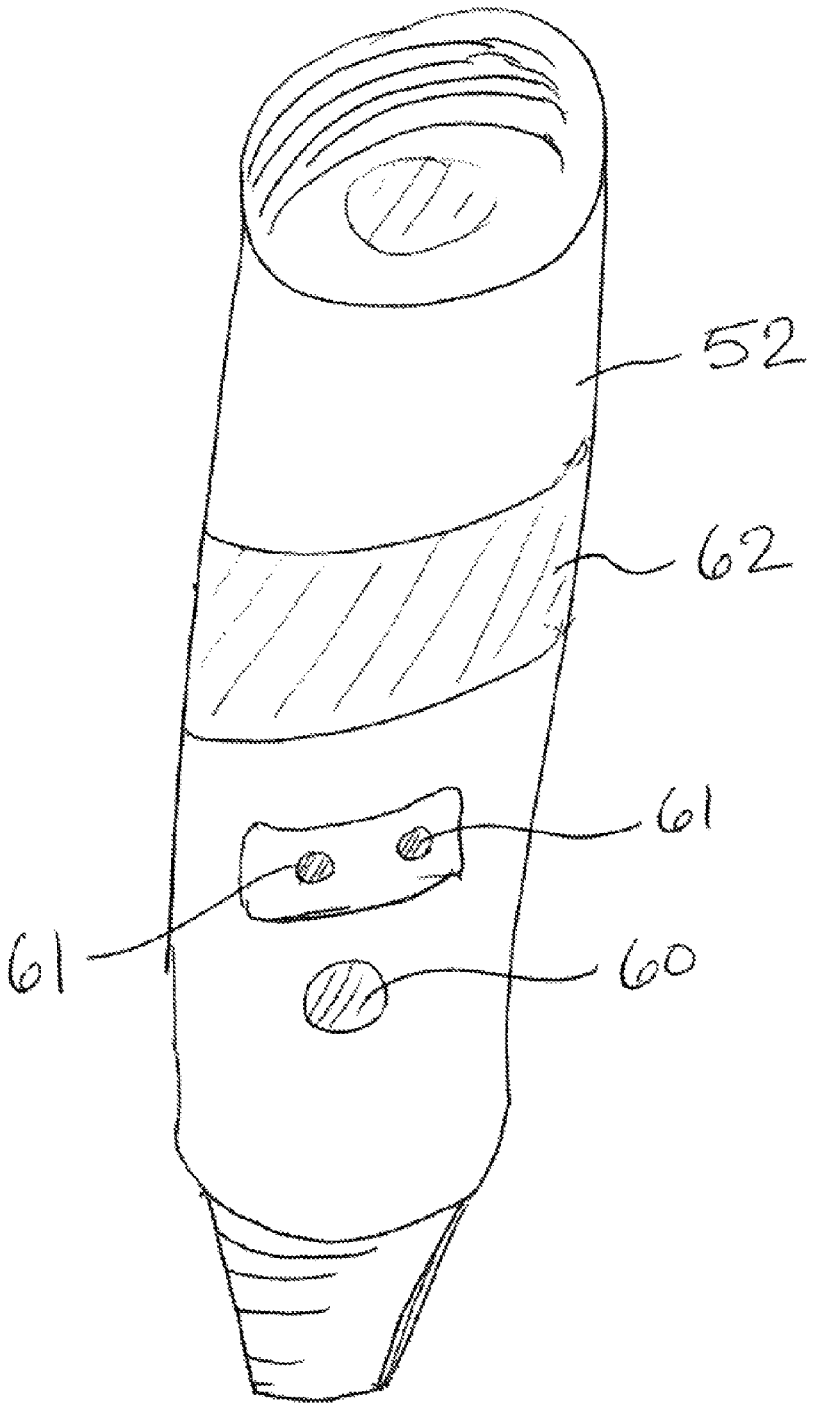
FIGS. 1A and 1B show apparatus according to non-limiting example embodiments.

FIG. 1A shows an example apparatus 50 having threaded couplings 50A and 50B at either end. In this embodiment, apparatus 50 is in the form of a gap sub having an electrically insulating gap 62 that electrically isolates uphole and downhole ends of the gap sub. An electromagnetic telemetry transmitter may be connected across gap 62.

Figure 1B:
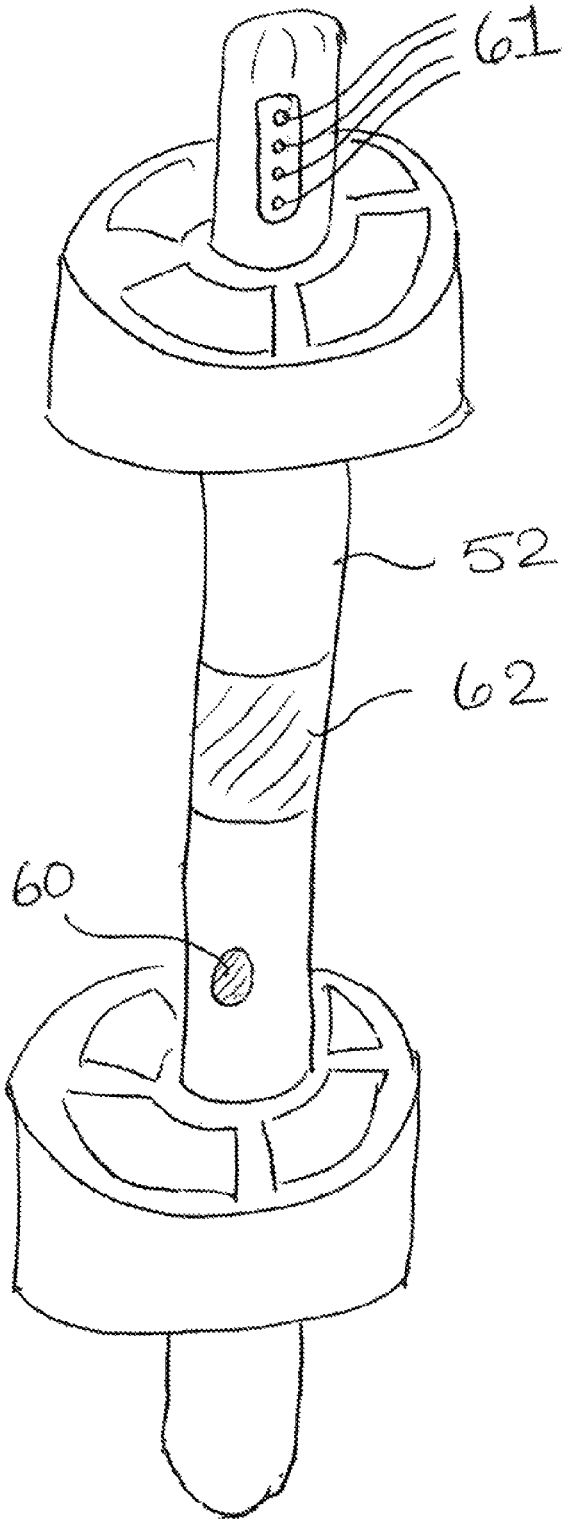

FIG. 1B shows another example apparatus 50 that is in the form of a probe that may be carried in a bore of a drill string.

In some embodiments, it is beneficial for apparatus 50 to be located downhole. Drilling fluids can include a combination of one or more of gaseous, liquid and/or solid phases, such as, water, oil, gas, flowable solid material etc. Drilling fluids in downhole conditions may exhibit different compositions, pressures and temperatures as compared to fluids at surface conditions. Electrical resistivity may also vary with depth since electrical resistivity can be dependent on temperature and pressure. As samples of downhole fluids are transported to the surface, the fluids are likely to change temperature and exhibit other changes in characteristics accordingly. Changes may include changes between gaseous and liquid phases and changes of compositional characteristics. Accordingly, fluid analysis performed downhole is likely to provide more accurate results than fluid analysis done at the surface (whether or not the fluid came from downhole).

Figure 2:
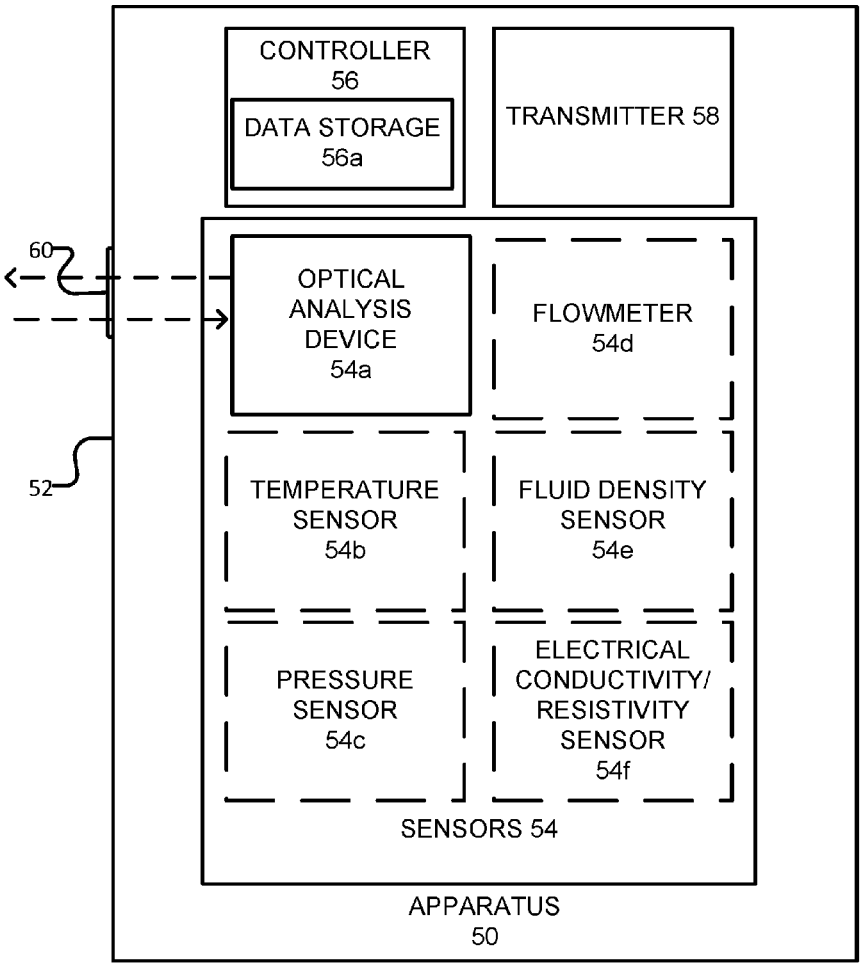
FIG. 2 is a block diagram of an exemplary apparatus for optimizing EM telemetry.

FIG. 2 depicts one embodiment of apparatus 50. Apparatus 50 may comprise a housing 52 containing one or more sensors (monitors, meters, etc.) 54. For example, apparatus 50 may comprise one or more of: an optical device 54*a*, such as a spectrometer, camera, imaging device, or the like, a temperature sensor 54*b*, a pressure sensor 54*c*, a flowmeter 54*d*, a fluid density sensor 54*e*, an electrical conductivity/resistivity meter 54*f*, a watercut meter (not shown), etc. Temperature sensor 54*b*, pressure sensor 54*c*, flowmeter 54*d*, fluid density sensor 54*e* and electrical conductivity/resistivity meter 54*f* are all optional components of apparatus 50, as illustrated by the stippled lines in FIG. 2. In some embodiments, one or more of: temperature sensor 54*b*, pressure sensor 54*c*, flowmeter 54*d*, fluid density sensor 54*e* and electrical conductivity/resistivity meter 54*f* may be located in another part of drilling rig 10, may be part of another downhole tool and may communicate with apparatus 50 or a computing device connected to apparatus 50. Apparatus 50 may also include a controller 56 for receiving data from the one or more sensors 54 and a transmitter 58 for transmitting data to the surface or to an intermediate transmitter or repeater.

Housing 52 of apparatus 50 may be generally cylindrical in form such that it can be inserted and travel within drill string 12, although this is not mandatory. Housing 52 may have one or more openings or optical accesses for allowing sensors 54 to adequately perform their functions. For example, optical access 60 may be provided in housing 52 such that optical device 54*a* has optical access to the drilling fluid. Other optical accesses 60 may be provided for other sensors 54 as needed.

Housing 52 may be made from a range of materials including metals and plastics suitable for exposure to downhole conditions. Some non-limiting examples are suitable thermoplastics, elastomeric polymers, rubber, copper or copper alloy, alloy steel, and aluminum. For example housing 52 may be made from a suitable grade of PEEK (Polyetheretherketone), PET (Polyethylene terephthalate) or PPS (Polyphenylene sulfide) plastic. Where housing 52 is made of plastic, the plastic may be fiber-filled (e.g. with glass fibers) for enhanced erosion resistance, structural stability and strength. The material of housing 52 should be capable of withstanding downhole conditions without degradation. The ideal material can withstand temperatures of up to at least 150 C (preferably 175 C or 200 C or more), is chemically resistant or inert to any drilling fluid to which it will be exposed, does not absorb fluid to any significant degree and resists erosion by drilling fluid. The material characteristics of housing 52 may be uniform, but this is not necessary.

Optical device 54*a* may sense light that has contacted the drilling fluid and rely on characterizing the sensed light to perform analysis of the fluid. In some embodiments, optical device 54*a* may physically sample the drilling fluid while in other embodiments, optical device may view the drilling fluid through optical access 60. Optical device 54*a* may comprise one or more light sources for illuminating the drilling fluid, one or more photo detectors that sense light that has contacted the drilling fluid in order to determine sensed data and processing elements that process the sensed data to determine fluid characteristics. Optical device 54*a* may use reflection-type lighting, fluorescent lighting, a light focussing device, light emitting diodes (LEDs) etc. for obtaining optimal lighting conditions.

In some embodiments, optical device 54*a* comprises a spectrometer. In particular, optical device 54*a* may comprise a near-infrared spectrometer (i.e. a spectrometer that uses the near-infrared region of the electromagnetic spectrum, from about 800 nm to about 2500 nm).

In some embodiments, housing 52 includes one or more optical accesses 60 such that optical device 54*a* can provide and receive light to and from the drilling fluid. In some embodiments, optical access 60 may have a protective covering to protect the contents of housing 52. The protective covering should be strong and allow visible light and near-infrared light to pass through. In some embodiments, the protective covering is made of glass or a polymer such as polycarbonate.

Optical access 60 may be located to optically analyze drilling fluid outside of a drill string or within a bore of the drill string. FIG. 1A shows an example embodiment in which optical access 60 is on an outside of a housing 52. Also shown in FIG. 1A are electrodes 61 which may be used for resistivity measurements by electrical conductivity/resistivity meter 54*f*.

The embodiment of FIG. 1B includes an optical access 60 which is located to permit drilling fluid flowing within a bore of a drill string to be analyzed. Also shown in FIG. 1B are contacts 61 for measuring resistivity of drilling fluid. An electromagnetic telemetry transmitter/receiver may be connected across electrically insulating gap 62 in housing 52.

Temperature sensor 54*b* may comprise any suitable temperature sensing device. For example, temperature sensor 54*b* may comprise an infrared thermometer, a thermocouple, a thermistor, resistance thermometers, etc. Temperature sensor 54*b* may be connected to controller 56.

Pressure sensor 54*c* may comprise any suitable pressure measuring device. For example, pressure sensor 54*c* may comprise a pressure transducer, a diaphragm gauge, a bellows gauge, a Bourdon gauge, etc. Pressure sensor 54*c* may be connected to controller 56. In some embodiments, since a number of pressure sensors may already be located downhole, pressure measurements from another sensor are transmitted to apparatus 50 or another sensor used in conjunction with apparatus 50.

Various types of commercially available fluid meters exist and are suitable for use as flowmeter 54*d*. In one particular embodiment, flow meter 54*d* is a turbine flow meter. Other types of flow meters that could be used include, but are not limited to, mechanical flow meters such as piston meters, oval gear meters, helical gear meters, nutating disk meters, variable area meters, Woltmann meters, single jet meters, and multiple jet meters; pressure-based meters such as venturi meters, orifice plates, dall tubes, pilot tubes, and cone meters; and optical flow meters. Flowmeter 54*d* may be connected to controller 56.

Fluid density sensor 54*e* may comprise any suitable fluid density sensing device. For example, fluid density sensor 54*e* may comprise a Coriolis meter, an ultrasonic density meter, a nuclear density gauge etc. Fluid density sensor 54*e* may be connected to controller 56.

Electrical conductivity/resistivity meter 54*f* may comprise any suitable electrical conductivity/resistivity measuring device. Since electrical conductivity of a solution (e.g. a drilling fluid) is highly temperature dependent, it is beneficial to either use a temperature compensated electrical conductivity/resistivity measuring device or to calibrate the measuring device at the same temperature as the solution being measured. In some embodiments, temperature sensor 54*b* and electrical conductivity/resistivity meter 54*f* are used together to obtain accurate temperature-compensated measurements. The electrical conductivity/resistivity meter 54*f* may be an electrode contacting type (with two or four electrodes) or an inductive type. In some embodiments, electrical conductivity/resistivity is measured across an electrically insulating gap also used for electromagnetic telemetry transmission and/or reception. In some embodiments, where electrical conductivity/resistivity meter 54*f* is not present, electrical resistivity may be approximated based on drilling fluid type. Drilling fluid type may be determined by comparing a spectrum obtained by optical device 54*a* to spectrums of known drilling fluid types. One or more of pressure and temperature readings may be used to calibrate the electrical resistivity reading approximation.

In some embodiments, the annulus fluid may be monitored for cuttings from formations. Such cuttings may indicate what type of formation is being drilled through.

Each sensor 54 may be configured to take continuous measurements, periodic measurements or measurements on command. Each sensor 54 may be configured to send all measurements to controller 56 or only measurements that exhibit a change. The change may be compared to a threshold change value or proportion such that only changes above the threshold level are sent to controller 56. The threshold may be set by an operator and may be adjusted as needed.

Transmitter 58 may comprise one or more of a number of suitable data transmission systems. In some embodiments, transmitter 58 is an EM telemetry transmitter that sends data directly to the surface. In other embodiments, transmitter 58 may send data to an EM telemetry repeater which in turn sends the data to another repeater or the surface. In other embodiments still, transmitter 58 may be any wired or wireless connection between apparatus 50 and an EM telemetry system.

Controller 56 (and components thereof) may comprise hardware, software, firmware or any combination thereof. For example, controller 56 may be implemented on a programmed computer system comprising one or more processors, user input apparatus, displays and/or the like. Controller 56 may be implemented as an embedded system with a suitable user interface comprising one or more processors, user input apparatus, displays and/or the like. Processors may comprise microprocessors, digital signal processors, graphics processors, field programmable gate arrays, and/or the like. Components of controller 56 may be combined or subdivided, and components of the controller may comprise sub-components shared with other components of the controller. Components of controller 56, may be physically remote from one another.

In some embodiments, apparatus 50 is configured to measure fluid characteristics using sensors 54, which transmit the measurements to controller 56. Controller 56 may then determine a set of optimal transmission settings 74 to be sent to the EM telemetry system or may cause the measurements to be transmitted to the surface via transmitter 58 and an appropriate telemetry system.

In a particular embodiment, apparatus 50 comprises a near-infrared spectrometer 54*a*, controller 56 and transmitter 58. Controller 56 may be configured to direct near-infrared spectrometer 54*a* to take a measurement of the drilling fluid. Infrared spectrometer 54*a* outputs a spectrum to controller 56. Controller 56 is configured to compare the measured spectrum to known spectrums of different types of drilling fluids (e.g. water-based fluids such as non-dispersed systems, dispersed systems, saltwater drilling fluids, polymer drilling fluids; drill in fluids; oil-based fluids; synthetic-based drilling fluids; all-oil fluids; and pneumatic-drilling fluids such as air, mist, foam or gas). Controller 56 may be configured to accommodate for the addition of one or more additives (e.g. spotting fluids, lubricants and protective chemicals such as scale and corrosion inhibitors, biocides, and hydrogen sulfide scavengers).

After matching the measured spectrum to a known spectrum of a drilling fluid type, transmission settings module 70 (which may be part of controller 56 or may be part of a surface computing device) determines optimal transmission settings 74. Each type of drilling fluid may be associated with a set of pre-determined optimal transmission settings 74. Optimal transmission settings 74 may comprise a settings profile that provides exact values depending on further variables such as depth, pressure or temperature of the drilling fluid. Optimal transmission settings 74 may also be based solely on the drilling fluid type or may be based on one or more of at least: transmission settings module 70 may receive one or more of: depth data 72*b*, signal detector layout data 72*c*, drilling casing data 72*d*, drilling activity data 72*e*, underground formations data 72*f*, electrical power data 72*g*, pre-existing transmission limitations 72*h*, historical transmission settings 72*j*, feedback from the surface 72*k* and transmission priority data 72*l*.

After determining optimal transmission settings 74, transmitter 58 may be configured to transmit optimal transmission settings 74 either to the surface to be accepted, altered or rejected by an operator, or directly to one or more transmitter/receivers that are part of the EM telemetry system. The EM telemetry system can uplink/downlink optimal transmission settings 74 so that each transmitter/receiver operates at the new optimal transmission settings 74. Apparatus 50 may be configured to take another measurement and start the process again.

In another particular embodiment, apparatus 50 comprises a near-infrared spectrometer 54*a*, temperature sensor 54*b*, electrical conductivity meter 54*f*, controller 56 and transmitter 58. Controller 56 may be configured to direct near-infrared spectrometer 54*a* to take a measurement of the drilling fluid. Infrared spectrometer 54*a* outputs a spectrum to controller 56. Apparatus 50, of this particular embodiment, is configured to operate in a substantially similar way as other embodiments of apparatus 50 except with the additional input of electrical resistivity and temperature of the drilling fluid for determining optimal transmission settings 74.

Another aspect of the invention provides a method for optimizing EM telemetry by automatically selecting or assisting a user in the selection of appropriate EM telemetry parameters which may include one or more of: voltage, current, power, EM telemetry signal carrier frequency, EM telemetry signal amplitude, and EM telemetry signal data encoding scheme. In particular, appropriate EM telemetry parameters may be optimized based on results of fluid analysis by sensors 54.

Figure 3:
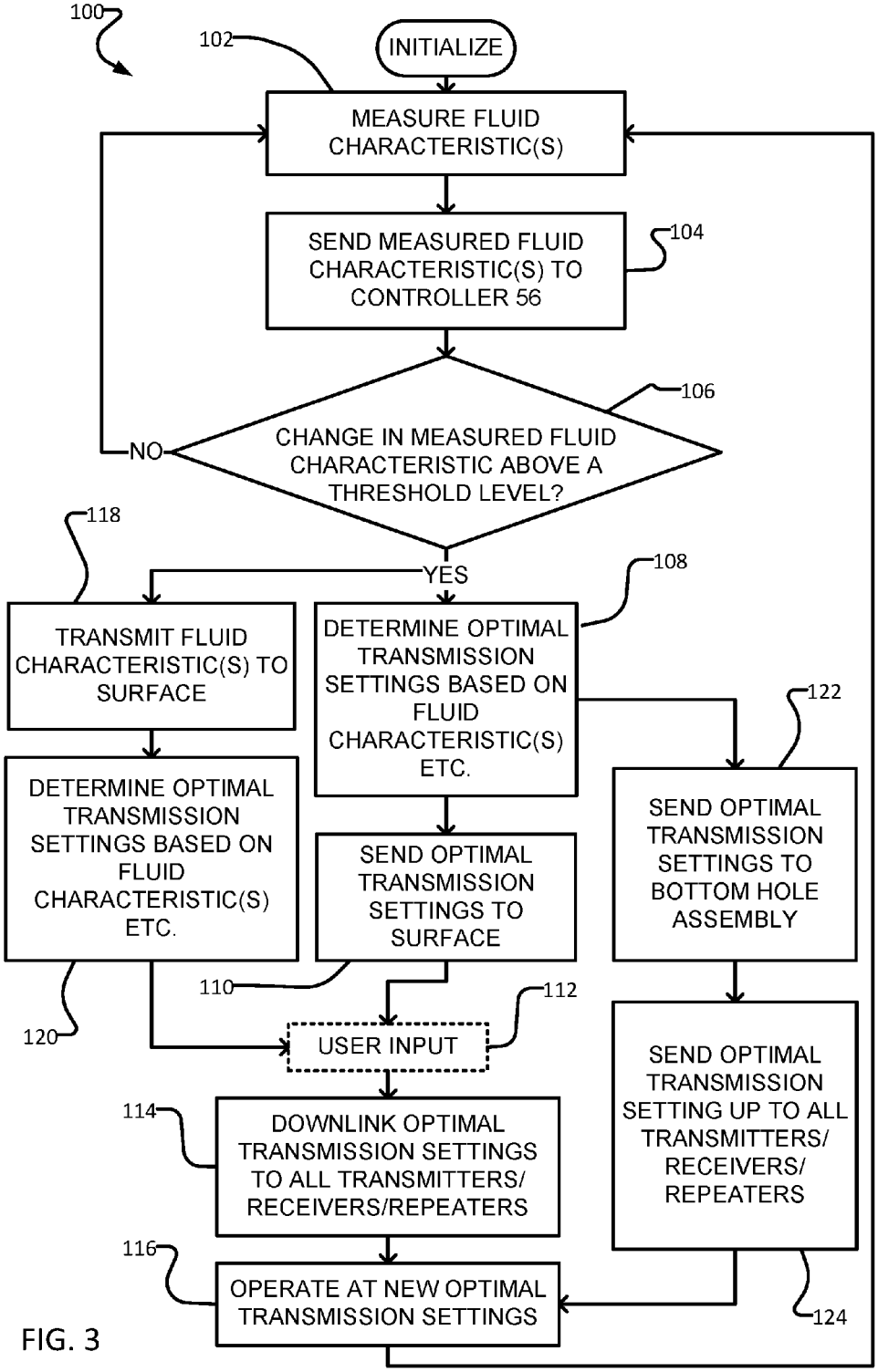
FIG. 3 is a flow chart illustrating an exemplary method for optimizing EM telemetry.

FIG. 3 provides a flowchart illustrating an exemplary method 100 for optimizing EM telemetry by selecting or assisting a user in the selection of appropriate EM telemetry parameters. In some embodiments, an operator may need to start the system while in other embodiments, the system is continuously in operation, continuously in operation while downhole or continuously in operation while drilling rig 10 is in operation.

In block 102, one or more fluid characteristics are measured. In some embodiments, resistivity/conductivity is measured (in some embodiments, for example, resistivity/conductivity may be inferred from composition). In some embodiments, the one or more fluid characteristics measured in block 102 comprise one or more of at least composition, phase behaviour, pressure, temperature, volume, density, electrical conductivity/resistivity etc. The one or more fluid characteristics measured may be measured at one particular location along drill string 12 or at several locations along drill string 12. The one or more fluid characteristics may all be measured at the same time, in sequence, periodically or continuously. In some embodiments, a number of measurements are taken and averaged. In some embodiments, measurements may be taken when the transmitter is within a formation being drilled through.

In block 104, the measured fluid characteristics are sent to controller 56. Measured fluid characteristics may be sent to controller 56 continuously or periodically. Controller 56 may include data storage 56*a* for storing measured fluid characteristics. Controller 56 may keep track of fluid characteristics and monitor fluid characteristics for any changes above a threshold value. Accordingly, in some embodiments, controller 56 may only transmit fluid characteristics that exhibit a change over a threshold value or proportion. In block 106, whether or not a threshold level of change has occurred in a measured fluid characteristic is determined. If the threshold level is met, the process goes to block 108 or block 118, depending on where the determination of optimal transmission settings 74 is performed.

The location(s) where transmission settings 74 are determined may vary in different embodiments. As shown in FIG. 3, after determining whether or not there is a change in a measured fluid characteristic above a threshold level, in block 106, the process may go to either of block 108 or block 118. If transmission settings module 70 is part of controller 52 of the downhole EM telemetry system or is located somewhere downhole such as in part of the BHA, the process goes to block 108. If transmission settings module 70 is located at the surface as part of a computer system located at the surface, the process goes to block 118. In block 118, the fluid characteristic(s) are transmitted to the surface before going to block 120 where the optimal transmission settings are determined.

Figure 4:
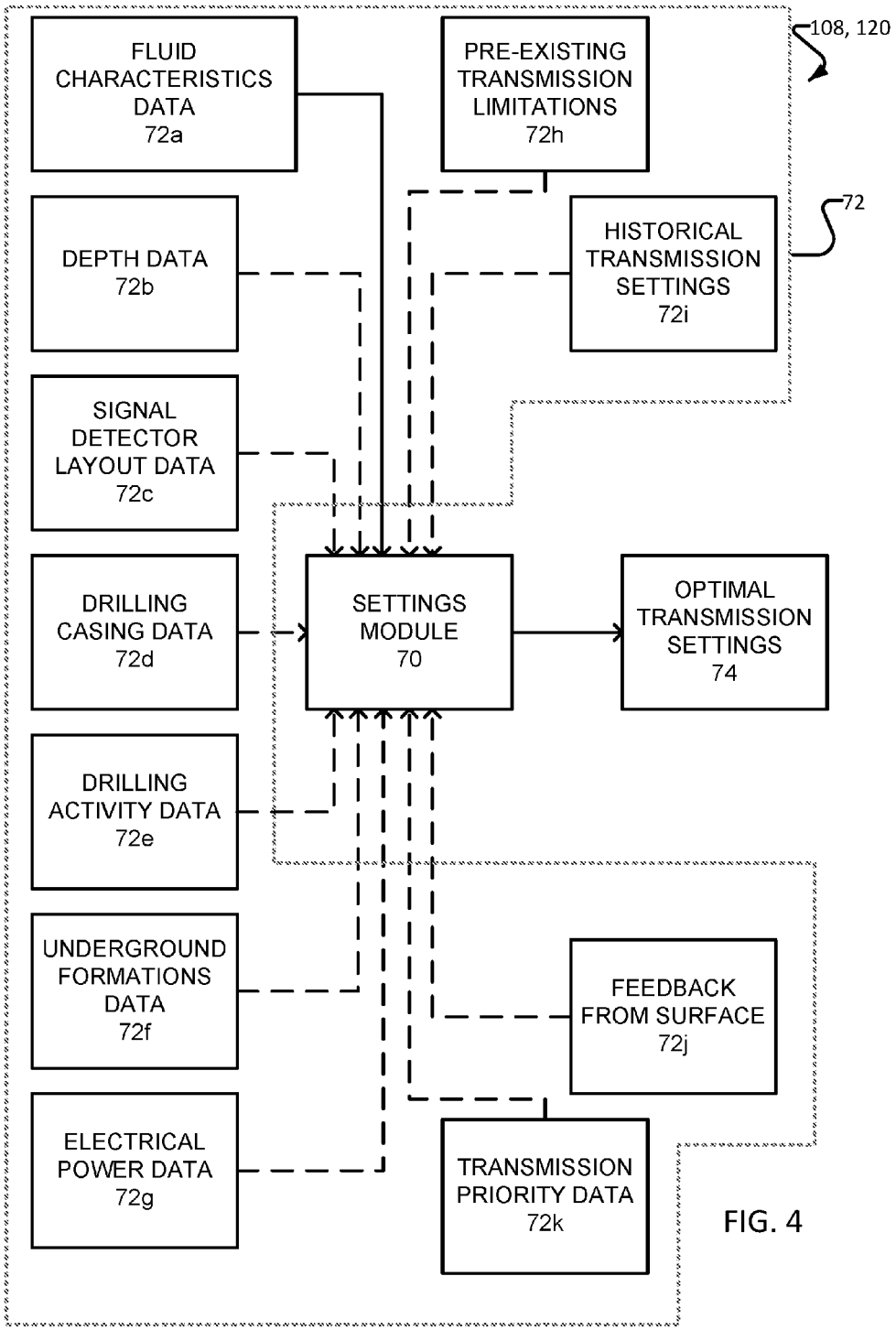
FIG. 4 is a block diagram illustrating an exemplary process for determining optimal EM transmission settings.

Block 108 and block 120 are similar, although they occur in different locations. In each of block 108 and block 120, optimal transmission settings 74 based on fluid characteristics are determined. FIG. 4 provides a schematic block diagram illustrating one embodiment of block 108 or block 120.

In FIG. 4, transmission settings module 70 receives one or more separate inputs. Each input is a different factor 72. It should be understood that inputting some of the factors 72 is optional (as is illustrated by the stippled lines between some of the factors 72 and transmission settings module 70). Using one or more factors 72, transmission settings module 70 determines a set of optimal transmission settings 74 for the EM telemetry system.

In determining optimal transmission settings 74, different factors can be given different weights depending on the objectives. In some embodiments, an objective is to obtain the best signal quality at the surface. In other embodiments, an objective may be to minimize energy usage while maintaining sufficient signal quality. In other embodiments, higher data throughput may be an objective. In other embodiments, the objective may be a combination of at least maximizing data throughput, conserving energy and obtaining the best signal quality at the surface.

Optimal transmission settings 74 may comprise a set of operating parameters for the EM telemetry system. The operating parameters may include one or more of voltage, current, power, EM telemetry signal carrier frequency, EM telemetry signal amplitude, and EM telemetry signal data encoding scheme. Optimal transmission settings 74 may comprise a range of values or exact values. Optimal transmission settings 74 may comprise a settings profile that provides settings values which depend on one or more of temperature, pressure and depth.

In some embodiments, transmission settings module 70 receives only fluid data characteristics as input for determining optimal transmission settings 74. As detailed above, fluid characteristics 72*a* may include one or more of at least composition, phase behaviour, pressure, temperature, volume, density, electrical conductivity/resistivity etc. Based on the one or more fluid characteristics 72*a*, transmission settings module 70 may determine optimal transmission settings 74 at which the EM telemetry system should operate.

In some embodiments, transmission settings module 70 comprises an algorithm, a lookup table or a function that provides transmission settings based on all of the available factors 72. In other embodiments, transmission settings module 70 comprises a plurality of algorithms, lookup tables or functions, one lookup table or function for each available factor 72, and transmission settings module 70 must balance and optimize the transmission settings based on the plurality of algorithms, lookup tables or functions to obtain the optimal transmission settings 74. In some embodiments, the lookup tables and/or functions are based on historical data while in other embodiments they are based on theoretical data. The algorithm(s), lookup table(s) and/or functions may be updated periodically based on actual results. Updates may be downlinked via an available telemetry system, may be determined downhole or may be applied when apparatus 50 is brought to the surface.

In some embodiments, based on the composition of the drilling fluid as measured by optical device 54*a*, transmission settings module 70 may determine that one or more transmission settings should be altered to obtain optimal transmission settings 74.

In some embodiments, optical device 54*a* may comprise a near-infrared spectrometer. The near-infrared spectrometer produces a spectrum corresponding to the drilling fluid for interpretation by transmission settings module 70. Transmission settings module may compare the measured spectrum to spectrums of known types of drilling fluid (e.g. water-based fluids such as non-dispersed systems, dispersed systems, saltwater drilling fluids, polymer drilling fluids; drill in fluids; oil-based fluids; synthetic-based drilling fluids; all-oil fluids; and pneumatic-drilling fluids such as air, mist, foam or gas) to find a closest match. In some embodiments, transmission settings module 70 is configured to accommodate additives within the drilling fluid that may affect the measured spectrum. In embodiments where optimal transmission settings 74 are determined at the surface, it may be beneficial to determine the drilling fluid type downhole (e.g. controller 56 may be configured to determine the drilling fluid type) in order to minimize the data that is transmitted to the surface.

After determining which type of drilling fluid is the closest match, transmission settings module 70 may determine a set of optimal transmission settings. For example, the transmission settings module 70 may determine that the power settings should be altered. In particular, lower power may be preferred in oil based drilling fluid while higher power may preferred in water/brine based drilling fluids. In other embodiments, one or more of the voltage, current, power, EM telemetry signal carrier frequency, EM telemetry signal amplitude, and EM telemetry signal data encoding scheme may also be altered based on the composition of the drilling fluid. Through use of the invention disclosed herein, further relationships may be discovered and known relationships may be refined.

In other embodiments, the measured spectrum may not provide a close match to any known drilling fluid, or any known combination of drilling fluid and additives. In such embodiments, apparatus 50 may be configured to run a signal sweep in order to determine optimal transmission settings 74. A signal sweep may comprise a plurality of signals at different frequencies. This method determines whether each of the sweep signals is received at the uphole system and for each sweep signal received, measures parameters of the received sweep signal. The parameters comprise at least one of signal strength and signal-to-noise ratio. Based at least in part on the sweep signals received and the parameters measured, the method determines a set of optimal transmission settings 74 for the unknown drilling fluid type. This set of optimal transmission settings 74 for the unknown drilling fluid type may be saved with the corresponding spectrum by transmission settings module 70 for future use.

In some embodiments, based on the temperature of the drilling fluid as measured by temperature sensor 54*b*, transmission settings module 70 may determine that one or more transmission settings should be altered to obtain optimal transmission settings 74. For example, the transmission settings module 70 may determine that the voltage and current should be altered. In water-based drilling fluids, the electrical resistivity of water decreases as the temperature increases. Higher temperatures therefore allow for higher maximum current draws. Accordingly, higher voltage and lower current may be preferred in lower temperature water-based drilling fluid while lower voltage and higher current may be preferred in higher temperature water-based drilling fluids. In other embodiments, one or more of voltage, current, power, EM telemetry signal carrier frequency, EM telemetry signal amplitude, and EM telemetry signal data encoding scheme may also be altered based on the temperature of the drilling fluid.

In some embodiments, based on the pressure of the drilling fluid as measured by pressure sensor 54*c*, transmission settings module 70 may determine that one or more transmission settings should be altered to obtain optimal transmission settings 74. For example, the transmission settings module 70 may determine that the voltage and current should be altered. In water-based drilling fluids, the electrical resistivity of water decreases as the pressure increases. Accordingly, higher voltage and lower current may be preferred in lower pressure water-based drilling fluid while lower voltage and higher current may be preferred in higher pressure water-based drilling fluids. In other embodiments, one or more of the voltage, current, power, EM telemetry signal carrier frequency, EM telemetry signal amplitude, and EM telemetry signal data encoding scheme may also be altered based on the pressure of the drilling fluid.

In some embodiments, based on the flow rate of drilling fluid as measured by flowmeter 54*d*, transmission settings module 70 may determine that one or more transmission settings should be altered to obtain optimal transmission settings 74. For example, the transmission settings module 70 may determine that one or more of the voltage, current, power, EM telemetry signal carrier frequency, EM telemetry signal amplitude, and EM telemetry signal data encoding scheme should be altered based on the flow rates of drilling fluid.

In some embodiments, based on the density of the drilling fluid as measured by density sensor 54*e*, transmission settings module 70 may determine that one or more transmission settings should be altered to obtain optimal transmission settings 74. For example, the transmission settings module 70 may determine one or more of the voltage, current, power, EM telemetry signal carrier frequency, EM telemetry signal amplitude, and EM telemetry signal data encoding scheme should be altered based on the density of the drilling fluid.

In some embodiments, based on the electrical resistivity of the drilling fluid as measured by electrical conductivity/resistivity meter 54*f*, transmission settings module 70 may determine that one or more transmission settings should be altered to obtain optimal transmission settings 74. The electrical resistivity may change due to changing fluid composition, temperature, pressure, or other fluid characteristics. In general, the voltage should increase with increasing electrical resistivity and the current should decrease with increasing resistivity. Conversely, the voltage should decrease with decreasing electrical resistivity and the current should increase with decreasing electrical resistivity. In other embodiments, one or more of the voltage, current, power, EM telemetry signal carrier frequency, EM telemetry signal amplitude, and EM telemetry signal data encoding scheme may also be altered based on the pressure of the drilling fluid.

In other embodiments, in addition to fluid characteristics data 72*a*, transmission settings module 70 may receive one or more of: depth data 72*b*, signal detector layout data 72*c*, drilling casing data 72*d*, drilling activity data 72*e*, underground formations data 72*f*, electrical power data 72*g*, pre-existing transmission limitations 72*h*, historical transmission settings 72*j*, feedback from the surface 72*k* and transmission priority data 72*l*. In some embodiments, transmission settings module 70 may receive additional data relating to additional factors.

Depth data 72*b* may, for example, relate to the depth at which the EM telemetry signal is being generated. At greater depths, greater attenuation is typically expected. Signal detector layout data 72*c* may relate to the arrangement of grounded electrodes 13B. Drilling casing data 72*d* may, for example, relate to whether or not there is a casing 16, how long casing 16 extends, the inclination of casing 16 and the inclination of the wellbore at the location of the EM telemetry signal generator. Drilling activity data 72*e* may, for example, relate to the current drilling mode such as whether or not there is a pump off condition and, if not, whether drilling is being performed in a sliding mode or in a rotating mode at which the entire drill string is being rotated. Underground formations data 72*f* may, for example, relate to the electrical conductivity of the underground environment on average or from place to place. Electrical power data 72*g* may, for example, relate to limits imposed by a desire to conserve electrical power and/or available reserves or electrical power. Pre-existing transmission limitations 72*h* may, for example, relate to a set of one or more transmission settings at which signals can be received at the surface under current operating conditions and any limitations of the telemetry hardware as discussed above. Historical transmission settings 72*i* may, for example, relate to the current transmission settings or data obtained from previous environments and transmission settings. Feedback from surface 72*j* may, for example, relate to feedback received based on the signals obtained by grounded electrodes 13B and signal receivers 13. Transmission priority data 72*k* may, for example, relate to a desired rate for certain data. For example, it may be desired to transmit "tool face" information—information specifying the current orientation of a drill bit—using a high data rate such that the information may be received at the surface with low latency.

In some embodiments, transmission settings module 70 receives feedback 72*j* from one or more grounded electrodes 13B and signal receivers 13 provided at the surface. The one or more grounded electrodes 13B and signal receivers 13 at the surface may measure signal attenuation and signal noise. Using feedback 72*j*, transmission settings module 70 may determine new transmission settings and/or may adjust the one or more lookup tables or functions for future use.

After determining optimal transmission settings 74 in block 108, optimal transmission settings 74 may be sent to the surface. At this point, the method moves to block 112 for one of block 120 and block 110. In block 112, an opportunity for user input is provided. In block 112, an operator may choose to accept, alter or reject optimal transmission settings 74. Block 112, which allows for user input is optional. In some embodiments, it is preferable to have no user input and for the EM telemetry system to run efficiently with little or no user input. After accepting or altering optimal transmission settings 74, optimal transmission settings 74 are sent (or downlinked) to some or all of the appropriate transmitters, receivers and repeaters that are part of the EM telemetry system.

The downlink transmission may be by EM telemetry but may also or instead be transmitted using another telemetry type. Example alternative telemetry types that may be used for the downlink telemetry include: mud pulse telemetry, drill string acoustic telemetry, telemetry performed by operating the drilling equipment e.g. by rotating the drill string and/or turning on or off the flow of drilling fluid or regulating the flow of drilling fluid in a pattern detectable by sensors at the downhole EM telemetry signal generator.

Alternatively, in other embodiments, after optimal transmission settings 74 are determined in block 108, the optimal transmission settings 74 may be sent to the BHA, as in block 122, before being transmitted to all appropriate transmitters, receivers and repeaters of the EM telemetry system, as in block 124.

After optimal transmission settings 74 are transmitted to all appropriate transmitters, receivers and repeaters of the EM telemetry system (either in block 116 or block 124), the EM telemetry system operates at the new optimal transmission settings 74, as in block 116, until the process begins again at block 102. The entire process may operate continuously, periodically, according to a schedule or at the command of an operator.

Downhole apparatus 50 and the EM telemetry system may be powered by one or more types of batteries located downhole. In some embodiments, to adjust voltage and current, different battery configurations may be employed. For example, to obtain high voltage and maintain the current, batteries may be connected in series whereas to obtain high current and maintain the voltage, batteries may be connected in parallel.

In other embodiments, characteristics of the drilling fluid may be such that the EM telemetry system should be shut down. In some embodiments, a backup form of telemetry may then be employed, such as mud pulse telemetry. In particular, in situations where the electrical resistivity of the drilling fluid is too high and too much power would be required to transmit EM telemetry signals, it may be beneficial to shut off the EM telemetry system to save power. Conversely, it may be beneficial to shut off the EM telemetry system for safety reasons when electrical resistivity of the drilling fluid is too low.

Another aspect of the invention provides a drill rig 10 having multiple apparatuses 50 spaced apart along drill sting 12. Each apparatus along drill sting 12 may measure fluid characteristics at its spaced apart location along drill sting 12. Transmission settings for EM transmitters may be adjusted according to the fluid characteristics as measured by the nearest apparatus 50. Accordingly, EM transmitters along drill string 12 may operate using different transmission settings in order to minimize attenuation and noise.

Embodiments of the invention may employ any suitable scheme for encoding data in an EM telemetry signal. One such scheme is QPSK (quadrature phase shift keying). Another scheme is BPSK (binary phase shift keying). A PSK (phase-shift keying) encoding scheme may use a number of cycles (at the current frequency) to transmit each symbol. The number of cycles used to transmit each symbol may be varied. For example, in low-noise environments one may be able to successfully transmit EM telemetry symbols using two cycles per symbol. In higher noise environments it may be desirable or necessary to use three cycles (or more) to transmit each symbol. In some embodiments the number of cycles to be used to encode a symbol is selected based on a measured signal-to-noise ratio (SNR) in a recent sweep. Other encoding schemes include FSK (frequency-shift keying), QAM (quadrature amplitude modulation), 8ASK (8 amplitude shift keying), APSK (amplitude phase shift keying) etc. Schemes which use any suitable combinations of changes in phase, amplitude, timing of pulses and/or frequency to communicate data may be applied.

Some embodiments make use of other modes of telemetry in addition to EM telemetry. For example, mud pulse telemetry may be used to transmit downlink signals and/or to transmit uplink signals. This capability may be used to allow communication to or from the downhole EM telemetry system to be made reliably and yet provide at least one mode of communication which has a relatively low latency to achieve rapid response of the downhole EM telemetry system. For example, rapid changes in the behaviour of the downhole EM telemetry system, e.g. switching between configuration files, could be achieved very quickly using fast EM downlink telemetry. Data that is less time sensitive to be transmitted to the EM telemetry system may be transmitted by a slower, but possibly more reliable in all circumstances, mode of data transmission. Transmission by different modes may occur simultaneously (concurrently) or overlapping in time or may be done at different times.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

INTERPRETATION OF TERMS

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.
- "herein", "above", "below", and words of similar import, when used to describe this specification shall refer to this specification as a whole and not to any particular portions of this specification.
- "or", in reference to a list of two or more items, covers all of the following interpretations of the word: any of the items in the list, all of the items in the list, and any combination of the items in the list.
- the singular forms "a", "an", and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back"," "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A method for optimizing electromagnetic telemetry, the method comprising:

measuring one or more drilling fluid characteristics at a downhole location;

determining optimal transmission settings for an electromagnetic telemetry system based on at least one of the one or more measured drilling fluid characteristics;

transmitting the optimal transmission settings to one or more electromagnetic transmitters; and operating the electromagnetic telemetry system according to the optimal transmission settings.

2. A method according to claim 1, wherein at least one of the one or more drilling fluid characteristics is measured by an optical device.

3. A method according to claim 2, wherein the optical device comprises a near-infrared spectrometer.

4. A method according to claim 3, wherein determining optimal transmission settings for an electromagnetic telemetry system based on at least one of the one or more drilling fluid characteristics comprises matching an infrared spectrum obtained by the near-infrared spectrometer to an infrared spectrums of a known drilling fluid.

5. A method according to claim 4, wherein determining optimal transmission settings for an electromagnetic telemetry system based on at least one of the one or more drilling fluid characteristics comprises choosing optimal transmission settings based at least in part on pre-determined optimal transmission settings for the known drilling fluid.

6. A method according to claim 3, wherein the optimal transmission settings comprise electromagnetic telemetry signal frequency settings.

7. A method according to claim 6, wherein the optimal transmission settings comprise electromagnetic telemetry signal amplitude settings.

8. A method according to claim 6, wherein the optimal transmission settings comprise electromagnetic telemetry signal voltage settings.

9. A method according to claim 6, wherein the optimal transmission settings comprise electromagnetic telemetry current settings.

10. A method according to claim 3, wherein the optimal transmission settings comprise electromagnetic telemetry signal power settings.

11. A method according to claim 3, wherein the optimal transmission settings comprise electromagnetic telemetry encoding scheme settings.

12. A method according to claim 2, wherein one of the one or more drilling fluid characteristics comprises composition of the drilling fluid.

13. A method according to claim 1, wherein one of the one or more drilling fluid characteristics comprises fluid temperature.

14. A method according to claim 1, wherein one of the one or more drilling fluid characteristics comprises fluid density.

15. A method according to claim 1, comprising receiving user input to accept or alter the optimal transmission settings.

16. A method according to claim 1, wherein the optimal transmission settings are determined downhole.

17. A method according to claim 1, wherein the optimal transmission settings are determined by a surface processor.

18. An apparatus for electromagnetic telemetry, the apparatus comprising:

an electromagnetic telemetry transmitter;

a housing;

an optical device located within the housing;

an optical access in the housing to allow light to pass to and from the optical device;

a controller configured to receive a measurement from the optical device and to compare the measurement to one or more measurement values associated with known drilling fluids to determine what type of drilling fluid is present;

wherein the controller is configured to set one or more electromagnetic telemetry transmission settings for the electromagnetic telemetry transmitter based at least in part on the determined type of drilling fluid present.

19. An apparatus according to claim 18, wherein the controller is configured to transmit the type of drilling fluid present to a surface receiver via the transmitter.

20. An apparatus according to claim 18, wherein the optical device comprises a near-infrared spectrometer.

21. An apparatus according to claim 18, comprising an electrical resistivity measuring device for obtaining an electrical resistivity measurement of drilling fluid and wherein the controller is configured to receive a measurement from the electrical resistivity measuring device and determine one or more electromagnetic telemetry transmission settings based at least on the type of drilling fluid present and the electrical resistivity measurement of the drilling fluid.

22. An apparatus according to claim 18, comprising a temperature sensor for obtaining a temperature measurement of drilling fluid and wherein the controller is configured to receive a temperature measurement from the temperature sensor and to determine one or more electromagnetic telemetry transmission settings for the transmitter based at least in part on the temperature measurement.

23. An apparatus according to claim 18, wherein the apparatus is incorporated into a downhole probe.

24. An apparatus for measuring drilling fluid characteristics, the apparatus comprising:

a housing;

an optical device located within the housing;

an optical access in the housing to allow light to pass to and from the optical device;

a controller configured to receive a measurement from the optical device and to compare the measurement to one or more measurement values associated with known drilling fluids to determine what type of drilling fluid is present;

wherein the apparatus is incorporated into a downhole probe and the housing comprises first and second threaded couplings for attaching the apparatus inline in a drill string.

25. An apparatus for measuring drilling fluid characteristics the apparatus comprising:

a housing;

an optical device located within the housing;

an optical access in the housing to allow light to pass to and from the optical device;

a controller configured to receive a measurement from the optical device and to compare the measurement to one or more measurement values associated with known drilling fluids to determine what type of drilling fluid is present and to determine one or more electromagnetic telemetry transmission settings for an electromagnetic telemetry transmitter based at least in part on the determined type of drilling fluid present;

wherein the optical device comprises a near-infrared spectrometer; and the controller is configured to process a spectrum obtained by the spectrometer to match the spectrum to one of a plurality of known types of drilling fluid using stored information regarding spectra of the known types of drilling fluid in a data store accessible to the controller and the controller is configured to determine the one or more telemetry transmission settings based at least on the one known type of drilling fluid matched by the spectrum obtained by the spectrometer.

26. An apparatus according to claim 25 wherein the data store records predetermined telemetry transmission settings for each of the plurality of known types of drilling fluid.

* * * * *